US009657481B2

(12) United States Patent
Florenske et al.

(10) Patent No.: US 9,657,481 B2
(45) Date of Patent: May 23, 2017

(54) DRY-BUILT WALL

(71) Applicant: Knauf Gips KG, Iphofen (DE)

(72) Inventors: Oliver Florenske, Möhnesee (DE); Sebastian Mittnacht, Würzburg (DE)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 14/758,869

(22) PCT Filed: Jan. 13, 2014

(86) PCT No.: PCT/EP2014/050511
§ 371 (c)(1),
(2) Date: Jul. 1, 2015

(87) PCT Pub. No.: WO2014/108543
PCT Pub. Date: Jul. 17, 2014

(65) Prior Publication Data
US 2015/0337538 A1 Nov. 26, 2015

(30) Foreign Application Priority Data
Jan. 11, 2013 (DE) ..... 20 2013 100 161 U

(51) Int. Cl.
*E04F 13/08* (2006.01)
*E04F 13/14* (2006.01)
(Continued)

(52) U.S. Cl.
CPC ..... *E04F 13/0832* (2013.01); *E04B 1/40* (2013.01); *E04B 2/7457* (2013.01);
(Continued)

(58) Field of Classification Search
CPC . E04F 13/0832; E04F 13/148; E04F 13/0826; E04F 13/0812; E04B 1/40;
(Continued)

(56) References Cited

U.S. PATENT DOCUMENTS

| | | | | |
|---|---|---|---|---|
| 2,056,328 A | | 10/1936 | Price | |
| 3,232,018 A | | 2/1966 | MacKean | |
| 3,962,840 A | | 6/1976 | Nelsson | |
| 4,395,858 A | | 8/1983 | Gwyther | |
| 4,480,360 A | * | 11/1984 | Brugman | E04B 9/26 24/292 |
| 4,726,165 A | * | 2/1988 | Brinsa | E04B 9/16 52/506.06 |
| 5,245,811 A | * | 9/1993 | Knorr | E04B 2/7409 403/382 |
| 5,822,941 A | * | 10/1998 | Kinsella | E04B 9/006 52/506.05 |
| 2008/0104926 A1 | * | 5/2008 | Lamfers | E04B 2/7425 52/787.1 |

(Continued)

FOREIGN PATENT DOCUMENTS

| | | |
|---|---|---|
| DE | 29611333 U1 | 9/1996 |
| WO | 2005072130 A2 | 8/2005 |

OTHER PUBLICATIONS

Office action in related European application No. 14700385.9 dated Aug. 26, 2016 (6 pages).*

(Continued)

*Primary Examiner* — Rodney Mintz
(74) *Attorney, Agent, or Firm* — Mark Terry

(57) ABSTRACT

The invention relates to a dry-built ceiling/wall, having a framework (1) and one or more construction panels (2) fixed to an associated upright profile (4), wherein the construction panels (2) are fixed to the respective upright profile (4) with the interposition of fastening elements (5) and to this end the fastening element (5) is equipped for example with lug ends (6) that grasp profile limbs (4*a*) of the upright profile (4). In addition to the at least two lug ends (6) for final fixing, the fastening element (5) is also equipped with one or more hooks (7) for pre-fixing the fastening element (5) to the respective profile limb (4*a*) of the upright profile (4).

11 Claims, 3 Drawing Sheets

Figure 1:
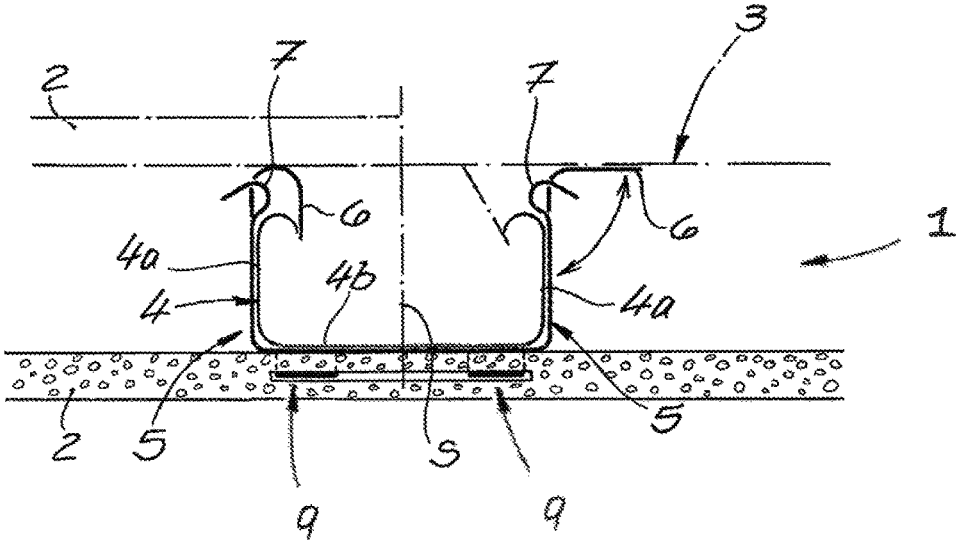

(51) Int. Cl.

| | |
|---|---|
| ***E04B 1/41*** | (2006.01) |
| *E04B 1/24* | (2006.01) |
| *E04B 9/10* | (2006.01) |
| *E04B 9/26* | (2006.01) |
| *E04B 9/28* | (2006.01) |
| *E04B 2/74* | (2006.01) |

(52) U.S. Cl.
CPC ..... *E04F 13/0812* (2013.01); *E04F 13/0826* (2013.01); *E04F 13/148* (2013.01); *E04B 9/10* (2013.01); *E04B 9/26* (2013.01); *E04B 9/28* (2013.01); *E04B 2001/2481* (2013.01); *E04B 2002/7464* (2013.01); *E04B 2002/7466* (2013.01)

(58) Field of Classification Search
CPC ..... E04B 2/7457; E04B 2001/2481; E04B 2002/7466; E04B 2002/7464; E04B 9/28; E04B 9/26; E04B 9/10
See application file for complete search history.

(56) References Cited

U.S. PATENT DOCUMENTS

2016/0201323 A1* 7/2016 Huwer ..... E04B 9/10
403/292

OTHER PUBLICATIONS

English Translation of the International Preliminary Report on Patentability for PCT/EP2014/050511 dated Jul. 14, 2015 (10 pages).*

International Search Report for Intl. App. No. PCT/EP2014/050511 dated Apr. 14, 2014, from which the instant application is based, 3 pgs.

* cited by examiner

DRY-BUILT WALL

RELATED APPLICATIONS

This application is a 35 U.S.C. 371 national stage filing from International Application No. PCT/EP2014/050511, filed Jan. 13, 2014, and claims priority to German Application No. 20 2013 100 161.9, filed Jan. 11, 2013, the teachings of each of which are incorporated herein by reference.

The invention relates to a dry-built ceiling/wall, having a framework and one or more construction panels fixed to an associated upright profile, wherein the construction panels are fixed to the respective upright profile with the interposition of fastening elements and to this end the fastening element is equipped for example with lug ends which engage around profile legs of the upright profile.

Dry-built ceilings and dry-built walls are characterised in that the ceiling or wall construction is produced without, for example, mortar and other water-based materials, i.e. "dry". The construction panels can typically be plasterboards, fibre-reinforced plasterboards, wooden panels. In principle, however, plastic panels or even metal panels can be used here. The invention of course also relates to construction panels made of the aforementioned materials in combination.

Standardised modes of procedure have proved to be particularly favourable for the construction of the upright profile, for example those which employ so-called C-profiles. Such C-profiles or C-profile rails are characterised by a C-shaped formation in cross-section. Vertically and/or horizontally running C-profiles or C-profile rails are typically employed, from which the upright profile is constructed. The construction panels are fixed to the upright profile.

For this purpose, the upright profile can be freestanding in the room, e.g. anchored to a floor and/or a ceiling, so that with the aid thereof the desired dry-built wall can be erected flexibly and quickly at the desired location in a building. Moreover, it is of course also conceivable to fix the upright profile to an existing wall (ceiling) or masonry, in order in this way to produce a lining of the wall (ceiling) or masonry in question with the aid of the construction panels.

The fixing of the individual construction panels to the framework either on one side or on both sides of the framework is carried out in practice in diverse ways. Thus, it is conceivable to screw the construction panels directly to the upright profile. As a consequence of this, however, screw holes or screw recesses necessarily arise at the surface of the construction panel, which have to be machined and closed. This is time-consuming and costly.

In the generic prior art, for example according to U.S. Pat. No. 3,962,840 or according to WO 2005/072130 A2, use is therefore made of fastening elements which are interposed between the framework or the respective upright profile and the construction panel to be fixed in each case to the latter. For this purpose, the known fastening elements are equipped with lug ends which engage around profile legs of the upright profile. The construction panel is then fixed to the associated fastening element. For this purpose, U.S. Pat. No. 3,962,840 again takes recourse to a screw connection, with the aid of which the construction panel is connected to the fastening element. In the context of WO 2005/072130 A2, the fastening element acts, as it were, as a support.

The prior art has been tried and tested in principle, but is in need of improvement with regard to the fitting and assembly. Thus, according to the previously described prior art, the fastening elements cannot be displaced or virtually cannot (any longer) be displaced after their one-off fixing to the upright profile. This means that the position of the fastening elements is more or less fixedly predetermined. Limitations thus result with regard to flexibility in the production of such dry-built ceiling/walls. The invention seeks to provide a general remedy here.

The technical problem underlying the invention is to develop further such a dry-built ceiling/wall in such a way that the production is simplified and in particular the flexibility with the fitting of the construction panels is increased.

To solve this technical problem, a generic dry-built ceiling/wall within the scope of the invention is characterised in that the fastening element is equipped, in addition to with the at least two lug ends for the final fixing, with one or more hooks for pre-fixing the fastening element to the respective profile leg of the upright profile.

The usual procedure is such that the lug ends for the final fixing permit, during the pre-fixing, a relative movement of the fastening element with respect to the upright profile, said relative movement being guided by the one or more hooks. Furthermore, it has proved to be beneficial if the lug ends for the final fixing of the fastening element are placed around the profile leg of the upright profile and/or fixed to the profile leg and/or anchored to a base.

The fastening element as such is usually constituted essentially U-shaped with two fastening legs and a fastening base. The respective fastening leg is equipped with at least one lug end and a hook. As a rule, two hooks are provided on both sides of the lug end located in between.

The hook and the lug end have an approximately identical spacing in relation to the fastening base. Moreover, the hook and the lug end are each connected at the top end to the associated fastening leg. It is usual to employ a material weakening zone. This means that the lug end is connected to the fastening leg with the interposition of this material weakening zone. The material weakening zone is typically a perforation.

For reasons of straightforward and cost-effective production, it has proved to be beneficial if the lug end, the hook and the fastening leg as well as the fastening base are produced in a uniform material from a metal, for example steel. The typical procedure is such that the fastening element according to the invention is produced for example from a metal blank. The individual steps for defining the one or more hooks as well as the lug ends and the material weakening zone can typically be carried out in sheet metal bending and punching steps connected in series. In principle, however, it is also possible for the fastening element to be produced virtually in one machining step.

In order to shape and equip the fastening element durably from the standpoint of its surface, a coating is normally employed. A zinc coating has in fact proved to be particularly favourable here as a corrosion protection for the fastening element.

The one or more construction panels are fixed to the framework with the aid of the U-base or fastening base. For this purpose, use can be made for example of connecting means. With the aid of these connecting means, the given construction panel is typically fixed to the U-base or fastening base. In principle, however, the U-base can also be equipped with, for example, fastening lugs or generally fastening means, with the aid of which the given construction panel is fixed to the fastening element. For this purpose, the construction panel can comprise for example a milled-in groove, which engages in the fastening means constituted lug-like.

As already explained in the introduction, the upright profile is usually constructed from essentially vertically and/or horizontally running C-profile rails. The vertically and/or horizontally running C-profile rails are usually connected to one another in the manner of latticework, so that with the aid thereof the desired dry-built ceiling or dry-built wall can ultimately be produced. The usual procedure is such that the fastening element in the fitted state on the C-profile rail lies with its fastening legs in each case adjacent to the associated C-leg, whilst the fastening base and a C-base are also disposed in contact with one another. As an alternative to this, it is however also conceivable and possible for the fastening base and the C-base to be disposed spaced apart from one another. This will be explained in greater detail by reference to the example of embodiment.

As a result, a dry-built ceiling or dry-built wall is made available, which can be constructed in a particularly straightforward, rapid and flexible manner. For this purpose, the upright profile is first erected, which is typically constructed from the vertically and/or horizontally running C-profile rails. The upright profile can be constituted freestanding in a room or also in front of a wall, a ceiling etc.

In order to be able to fix the construction panels to the upright profile constituted in this way, the invention takes recourse to special fastening elements. Within the scope of the present teaching, these fastening elements can be pre-fixed to the associated profile leg or the plurality of profile legs. For this purpose, the fastening element is equipped with the one or more hooks for pre-fixing to the respective profile Leg of the upright profile. During the pre-fixing, these hooks permit a guided relative movement of the fastening element with respect to the upright profile. In this context, the hooks in fact make provision such that the respective fastening element can be moved relatively along that the upright profile until finally the position of the fastening element desired by the erecting engineer of the dry-built ceiling or dry-built wall is reached. Only then does the final fixing take place.

The at least two lug ends provide for the final fixing. In order that the final fixing can be carried out as easily and quickly as possible and with as little effort as possible, the lug ends in question are connected to the fastening leg by the respective material weakening zone or perforation. An erecting engineer or drywall worker can thus bend over the lug end in question manually without any problem and thus fix the fastening element to the profile leg of the upright profile or also to the base.

Different construction panels can thus be fixed without problem and quickly to the upright profile. This means that, for example, plasterboards or gypsum plaster boards as well as wooden panels can be fixed on the framework quickly, reliably and easily. Various fastening elements are often used in practice here, which within the scope of the invention can be dispensed with. On the contrary, it is sufficient to use just one and the same fastening element for completely differently constituted construction panels.

In addition, there is the fact that the fastening element concerned can be combined without problem with pre-existing frameworks. This means that special adaptations, approval examinations, test routines etc. are not required, because for the most part recourse can be taken to conventional and tried and tested components to produce the dry-built ceiling or dry-built wall according to the invention. It is in this that the main advantages are to be seen.

Figure 2:
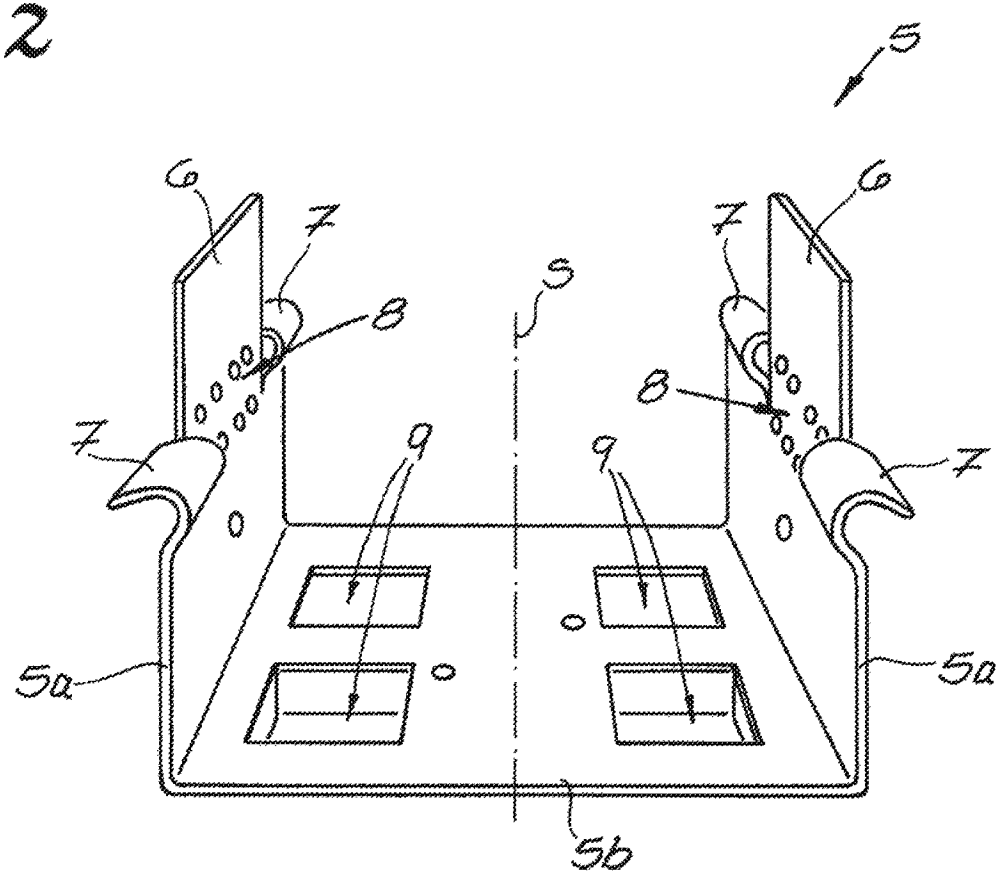
Figure 3:
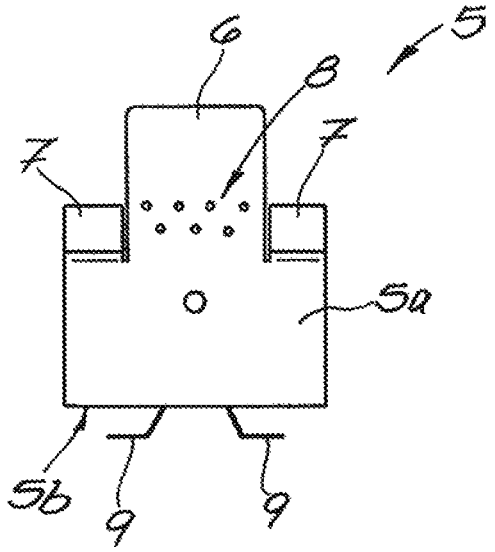
Figure 4:
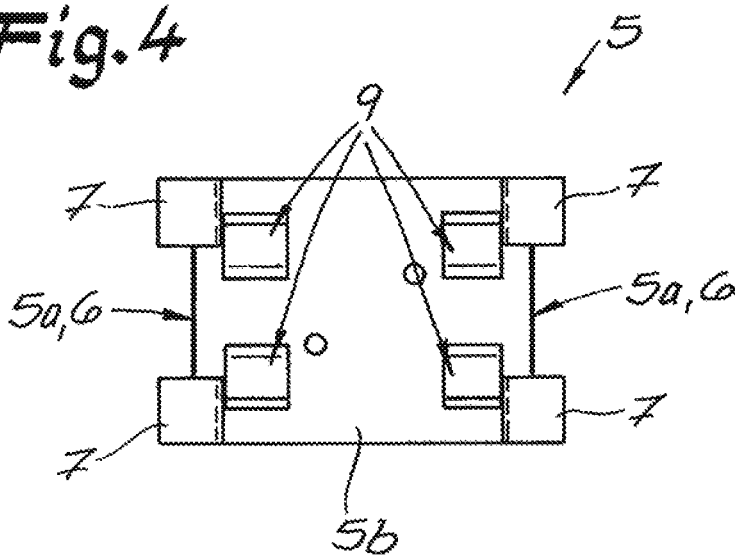

The invention is explained in greater detail below on the basis of a drawing representing merely an example of embodiment; in the figures:

FIG. 1 shows a dry-built ceiling or dry-built wall according to the invention in a diagrammatic cross-sectional representation, FIG. 2 shows the fastening element according to the invention used to produce the dry-built wall or dry-built ceiling according to FIG. 1, in a perspective view, and FIGS. 3 and 4 show different views of the fastening element according to FIG. 2.

A dry-built ceiling or dry-built wall is represented in the figures, which is equipped according to FIG. 1 with a framework 1. Within the scope of the example of embodiment, framework 1 is a vertical C-profile rail 4 as an upright profile 4. As a rule, a plurality of vertical C-profile rails 4 are provided, which moreover are or can be connected to one another by horizontal C-profile rails 4 or otherwise. A plurality of construction panels 2 are fixed to framework 1 in question. Construction panels 2 can be plasterboards, fibre-reinforced plasterboards, wooden panels, plastic panels, metal panels or also combinations. A wall 3 can thus be lined with the aid of construction panels 2. In principle, however, the dry-built ceiling or dry-built wall thus produced can also be freely arranged in a room, so that construction panels 2 are located on both sides of the framework 1.

Individual construction panels 2 are fixed to associated upright profile 4. In the context of the example of embodiment, upright profile 4 is C-profile rail 4 with C-legs 4*a* and a C-base 4*b*.

Within the scope of the invention, construction panels 2 are fixed to upright profile 4 with the aid of fastening element 5. It can be seen from FIGS. 2 to 4 that fastening element 5 is constituted essentially U-shaped. Fastening element 5 in fact comprises two fastening legs 5*a* and a fastening base 5*b*. Moreover, it can be seen that fastening element 5 is equipped with lug ends 6 and hooks 7. Two hooks 7 are in fact provided, which are disposed on both sides of lug end 6 located in between. Both hooks 7 and respective lug end 6 are connected at the top to associated fastening leg 5*a* and extend at the top of respective fastening leg 5*a*.

The layout is made in such a way that both hooks 7 and respective lug end 6 have an approximately identical spacing from common fastening faces 5*b* and, as already described, are each connected at the top end to associated fastening leg 5*a*. At the connection of lug end 6 to associated fastening leg 5*a*, it is noteworthy that a material weakening zone 8 is interposed at this point. Material weakening zone 8 is a perforation 8. This means that fastening leg 5*a* transforms at the top first into material weakening zone or perforation 8, which is then followed by respective lug end 6. Respective hooks 7 are provided on both sides of material weakening zone 8 or lug end 6.

It can be seen that respective hooks 7 are constituted as spring hooks. Furthermore, hooks 7 comprise a hook head directed in each case into the interior of fastening element 5 or inwards, which hook head is pressed back in a spring-elastic manner when the fastening element 5 is fitted to upright profile 4 or associated profile rail 4 and usually engages at the end over associated profile leg 4*a* of upright profile 4. Fastening element 5 can thus be pre-fixed to upright profile 4. This is because hooks or spring hooks 7 ensure that in each case they engage over or engage behind the end of profile leg 4*a*, so that fastening element 5 is fixed to C-profile rail 4, but can continue to perform a relative movement with respect to upright profile 4, i.e. in the longitudinal direction of upright profile 4.

In the context of the pre-fixing, fastening element 5 can be clipped, as it were, to upright profile 4, wherein fastening element 5 can be displaced along upright profile 4 or associated C-profile rail 4. Fastening element 5 can thus be fixed by a drywall constructor precisely at the point where construction panel 2 to be fitted thereto is to be positioned. Only in the course of the final fixing are lug ends 6 placed in position on respective profile leg 4*a* of upright profile 4 or placed in position around profile leg 4 in question, as is represented in FIG. 1. Fastening element 5 is then fixedly connected or finally fixed to upright profile 4.

As an alternative to this, respective lug end 6 can however also be placed in position on profile leg 4*a* in question, as is indicated in the left-hand part of FIG. 1. A further construction panel or a plurality of further construction panels 2, for example, can then follow to the rear on upright profile 4. Moreover, it is possible for lug end 6 to be fixed to base 3, as is shown in the right-hand part of FIG. 1. In this case, upright profile 4 can serve, in connection with construction panels 2, as a lining of base 3.

It is the case for both variants that fastening element 5 is thus equipped, in addition to with the at least two lug ends 6 for the final fixing, with the two hooks 7 for a pre-fixing to respective profile leg 4*a* of upright profile 4. After the pre-fixing, fastening element 5 can be displaced along upright profile 4 into the desired position. Fastening element 5 is thus equipped, in addition to with the at least two lug ends 6 for the final fixing, with the two hooks 7 for its pre-fixing to respective profile leg 4 of upright profile 1.

Only when its final position is reached and meets to the expectations of the drywall builder does the final fixing take place. For this purpose, the one lug end or the two lug ends 6 are bent over. This bending process is facilitated by perforation 8 interposed in each case. This means that, having regard to material weakening zone or perforation 8, lug end 6 can be bent over or bent off at virtually any angle with respect to fixed and associated fastening leg 5*a*.

In the context of the example of embodiment, lug end 6, respective hook 7, fastening leg 5*a* and finally fastening base 5*b* are produced in a uniform material from a metal and for example steel. The production can be carried out in one operation by typical punching/bending steps, so that fastening element 5 can be produced in a particularly straightforward and cost-effective manner. In addition, fastening element 5 is typically provided with a coating and in particular a zinc coating in order to prevent any corrosion. Moreover, fastening element 5 has a mirror-symmetrical configuration in relation to a central plane of symmetry S, which is indicated only in FIG. 2. The production is thus further facilitated.

U-base or fastening base 5*b* of the fastening element 5 is as a rule available for the fitting of construction panels 2 to fastening element 5. In point of fact, use is usually made here of connecting means 9, with the aid of which respective construction panel 2 is fixed to fastening element 5. Connecting means 5 in question can be a lug fixed to U-base 5*b* or also a separate screw etc. In the example of embodiment according to FIG. 1, connecting means 9 is constituted as a lug engaging in a groove of respective construction panel 2. This is of course only by way of example. This is because, in principle, construction panels 2 can alternatively also be connected adhesively to the U-base of fastening element 5 or—as already described—by screwing or otherwise.

Fastening element 5 can be coupled with profile rail 4 in fundamentally different ways. Thus, it is conceivable for fastening element 5 in the fitted state to lie in each case with its fastening legs 5*a* adjacent to associated fastening legs or C-legs 4*a* of profile rail 4. U-base 5*b* of fastening element 5 and C-base 4*b* of profile rail 4 can also be disposed in contact with one another, as represented in FIG. 1. As an alternative to this, however, it is also possible for U-base or fastening base 5*b* of fastening element 5 and C-base 4*b* of profile rail 4 to be spaced apart from one another. This is not however represented in detail.

Fastening means 9 can be disposed in any way on U-base 5*b* of fastening element 5. Transverse arrangements and/or longitudinal arrangements are thus conceivable and lie within the scope of the invention. A detachable fixing of fastening means 9 to respective U-base 5*b* of fastening element 5 is also covered by the invention.

As a result of the possible pre-fixing of respective fastening element 5 to C-profile rail 4 or the C-profile rail, it is possible to pre-assemble framework 1 within the scope of the invention not only as described, but also C-profile rails 4 can be supplied in common together with fastening elements 5 in a pre-fixed state. The number of transported parts and parts to be kept in stock is thus reduced and the outlay on assembly and erection is also reduced. It is in this that the main advantage is to be seen.

The invention claimed is:

1. A dry-built ceiling or wall, having a framework (1), and one or more construction panels (2) fixed to an associated upright profile (4), wherein the construction panels (2) are fixed to a respective said upright profile (4) and interposed with fastening elements (5) and on one end the fastening element (5) is equipped with lug ends (6) which engage around a respective profile leg (4*a*) of the upright profile (4), wherein the fastening element (5) is equipped, in addition to with at least two lug ends (6) with one or more hooks (7) for pre-fixing the fastening element (5) to the respective profile leg (4*a*) of the upright profile (4), wherein the fastening element (5) is constituted U-shaped with two fastening legs (5*a*) and a fastening base (5*b*) and wherein the respective fastening leg (5*a*) is equipped with at least one said lug end (6) and a respective said hook (7), a material weakening zone (8) is positioned between the at least one lug end (6) and the respective fastening leg (5*a*), and the fastening base (5*b*) of the fastening element (5) is equipped with connecting means (9) for fixing the construction panels (2).

2. The dry-built ceiling or wall according to claim 1, characterised in that the lug ends (6) permit, during the pre-fixing, a relative movement of the fastening element (5) with respect to the upright profile (4), said relative movement being guided by the hook (7).

3. The dry-built ceiling or wall according to claim 1, characterised in that the lug ends (6) for final fixing of the fastening element (5) are placed around the profile leg (4*a*) of the upright profile (4), fixed to the profile leg (4*a*), or anchored to a base (3).

4. The dry-built ceiling or wall according to claim 1, characterised in that two hooks (7) are provided on both sides of the lug end (6) located in between.

5. The dry-built ceiling orwall according to claim 1, characterised in that the hook (7) and the lug end (6) are connected with approximately identical spacing from the fastening base (5*b*) in each case at the top end to the associated fastening leg (5*a*).

6. The dry-built ceiling or wall according to claim 1, characterised in that the material weakening zone (8) is constituted as a perforation (8).

7. The dry-built ceiling or wall according to claim 1, characterised in that the lug end (6), the hook (7) and the fastening leg (5*a*) as well as the fastening base (5*b*) are produced in a uniform material from a metal.

8. The dry-built ceiling or wall according to claim 1, characterised in that the fastening element (5) is constituted mirror-symmetrical in relation to a central plane of symmetry (S).

9. The dry-built ceiling or wall according to claim 1, characterised in that the fastening element (5) has a coating as a corrosion protection.

10. The dry-built ceiling or wall according to claim 1, characterised in that the framework (1) is constructed from vertically or horizontally running C-profile rails (4) as an upright profile (4) in each case.

11. The dry-built ceiling or wall according to claim 10, characterised in that the fastening element (5) in the fitted state on the C-profile rail (4) lies with the fastening legs (5*a*) in each case adjacent to C-legs (4*a*), whilst the fastening base (5*b*) and a C-base (4*b*) are also disposed in contact with one another or spaced apart from one another.

* * * * *